US007597146B2

(12) United States Patent
Winslow et al.

(10) Patent No.: US 7,597,146 B2
(45) Date of Patent: Oct. 6, 2009

(54) METHODS AND APPARATUS FOR COMPLETION OF WELL BORES

(75) Inventors: Donald Winslow, Duncan, OK (US); Alton Branch, Comanche, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 344 days.

(21) Appl. No.: 11/539,473

(22) Filed: Oct. 6, 2006

(65) Prior Publication Data

US 2008/0083535 A1 Apr. 10, 2008

(51) Int. Cl.
*E21B 33/14* (2006.01)

(52) U.S. Cl. ..... 166/285; 166/177.4; 166/90.1

(58) Field of Classification Search ..... 166/285, 166/131, 69, 177.4, 90.1, 70
See application file for complete search history.

(56) References Cited

U.S. PATENT DOCUMENTS

| | | | |
|---|---|---|---|
| 2,223,509 | A | 12/1940 | Brauer |
| 2,230,589 | A | 2/1941 | Driscoll |
| 2,306,160 | A | 12/1942 | Freyssinet |
| 2,407,010 | A | 9/1946 | Hudson |
| 2,472,466 | A | 6/1949 | Counts et al. |
| 2,647,727 | A | 8/1953 | Edwards |
| 2,675,082 | A | 4/1954 | Hall |
| 2,849,213 | A | 8/1958 | Failing |
| 2,919,709 | A | 1/1960 | Schwegman |
| 3,051,246 | A | 8/1962 | Clark, Jr. et al. |
| 3,193,010 | A | 7/1965 | Bielstien |
| 3,277,962 | A | 10/1966 | Flickinger et al. |
| 3,570,596 | A | 3/1971 | Young |
| 3,915,227 | A | 10/1975 | Simpson |
| 3,948,322 | A | 4/1976 | Baker |
| 3,948,588 | A | 4/1976 | Curington et al. |
| 3,951,208 | A | 4/1976 | Delano |

(Continued)

FOREIGN PATENT DOCUMENTS

| | | |
|---|---|---|
| EP | 0 419 281 A2 | 3/1991 |

(Continued)

OTHER PUBLICATIONS

Foreign communcation related to a counterpart application dated Feb. 4, 2008.

(Continued)

*Primary Examiner*—Jennifer H Gay
*Assistant Examiner*—David Andrews
(74) *Attorney, Agent, or Firm*—John W. Wustenberg; Baker Botts, LLP

(57) ABSTRACT

Methods and devices for completion of well bores and more particularly, to reverse circulation cementing of casing strings in well bores are provided. One example of a method may comprise a method for providing fluidic access to an outer annulus of a casing string within a well bore. One example of a device may comprise a casing hanger, the casing hanger comprising a fluid port wherein the fluid port provides fluidic access to an outer annulus by allowing fluid to pass through the casing hanger; a landing sub attached to the casing hanger; and an isolation device attached to the landing sub wherein the isolation device is adapted to allow fluidic isolation of a portion of the landing sub from a portion of the outer annulus of the well bore.

22 Claims, 11 Drawing Sheets

U.S. PATENT DOCUMENTS

| | | | | |
|---|---|---|---|---|
| 4,105,069 | A | 8/1978 | Baker | |
| 4,271,916 | A | 6/1981 | Williams | |
| 4,300,633 | A | 11/1981 | Stewart | |
| RE31,190 | E | 3/1983 | Detroit et al. | |
| 4,469,174 | A | 9/1984 | Freeman | |
| 4,519,452 | A | 5/1985 | Tsao et al. | |
| 4,531,583 | A | 7/1985 | Revett | |
| 4,548,271 | A | 10/1985 | Keller | |
| 4,555,269 | A | 11/1985 | Rao et al. | |
| 4,671,356 | A | 6/1987 | Barker et al. | |
| 4,676,832 | A | 6/1987 | Childs et al. | |
| 4,791,988 | A | 12/1988 | Trevillion | |
| 4,961,465 | A | 10/1990 | Brandell | |
| 5,024,273 | A | 6/1991 | Coone et al. | |
| 5,117,910 | A | 6/1992 | Brandell et al. | |
| 5,125,455 | A | 6/1992 | Harris et al. | |
| 5,133,409 | A | 7/1992 | Bour et al. | |
| 5,147,565 | A | 9/1992 | Bour et al. | |
| 5,188,176 | A | 2/1993 | Carpenter | |
| 5,213,161 | A | 5/1993 | King et al. | |
| 5,273,112 | A | 12/1993 | Schultz | |
| 5,297,634 | A | 3/1994 | Loughlin | |
| 5,318,118 | A | 6/1994 | Duell | |
| 5,323,858 | A | 6/1994 | Jones et al. | |
| 5,361,842 | A | 11/1994 | Hale et al. | |
| 5,484,019 | A | 1/1996 | Griffith | |
| 5,494,107 | A | 2/1996 | Bode | 166/285 |
| 5,507,345 | A | 4/1996 | Wehunt, Jr. et al. | |
| 5,559,086 | A | 9/1996 | Dewprashad et al. | |
| 5,571,281 | A | 11/1996 | Allen | |
| 5,577,865 | A | 11/1996 | Manrique et al. | |
| 5,641,021 | A | 6/1997 | Murray et al. | |
| 5,647,434 | A | 7/1997 | Sullaway et al. | |
| 5,671,809 | A | 9/1997 | McKinzie | |
| 5,718,292 | A | 2/1998 | Heathman et al. | |
| 5,738,171 | A | 4/1998 | Szarka | |
| 5,749,418 | A | 5/1998 | Mehta et al. | |
| 5,762,139 | A | 6/1998 | Sullaway et al. | |
| 5,803,168 | A | 9/1998 | Lormand et al. | |
| 5,829,526 | A | 11/1998 | Rogers et al. | |
| 5,875,844 | A | 3/1999 | Chatterji et al. | |
| 5,890,538 | A | 4/1999 | Beirute et al. | |
| 5,897,699 | A | 4/1999 | Chatterji et al. | |
| 5,900,053 | A | 5/1999 | Brothers et al. | |
| 5,913,364 | A | 6/1999 | Sweatman | |
| 5,968,255 | A | 10/1999 | Mehta et al. | |
| 5,972,103 | A | 10/1999 | Mehta et al. | |
| 6,060,434 | A | 5/2000 | Sweatman et al. | |
| 6,063,738 | A | 5/2000 | Chatterji et al. | |
| 6,098,710 | A | 8/2000 | Rhein-Knudsen et al. | |
| 6,138,759 | A | 10/2000 | Chatterji et al. | |
| 6,143,069 | A | 11/2000 | Brothers et al. | |
| 6,167,967 | B1 | 1/2001 | Sweatman | |
| 6,196,311 | B1 | 3/2001 | Treece et al. | |
| 6,204,214 | B1 | 3/2001 | Singh et al. | |
| 6,244,342 | B1 | 6/2001 | Sullaway et al. | 166/285 |
| 6,258,757 | B1 | 7/2001 | Sweatman et al. | |
| 6,311,775 | B1 | 11/2001 | Allamon et al. | |
| 6,318,472 | B1 | 11/2001 | Rogers et al. | |
| 6,367,550 | B1 | 4/2002 | Chatterji et al. | |
| 6,431,282 | B1 | 8/2002 | Bosma et al. | |
| 6,454,001 | B1 | 9/2002 | Thompson et al. | |
| 6,457,524 | B1 | 10/2002 | Roddy | |
| 6,467,546 | B2 | 10/2002 | Allamon et al. | |
| 6,481,494 | B1 | 11/2002 | Dusterhoft et al. | |
| 6,484,804 | B2 | 11/2002 | Allamon et al. | |
| 6,488,088 | B1 | 12/2002 | Kohli et al. | |
| 6,488,089 | B1 | 12/2002 | Bour et al. | |
| 6,488,763 | B2 | 12/2002 | Brothers et al. | |
| 6,540,022 | B2 | 4/2003 | Dusterhoft et al. | |
| 6,622,798 | B1 | 9/2003 | Rogers et al. | |
| 6,666,266 | B2 | 12/2003 | Starr et al. | |
| 6,732,797 | B1 | 5/2004 | Watters et al. | |
| 6,758,281 | B2 | 7/2004 | Sullaway et al. | |
| 6,802,374 | B2 | 10/2004 | Edgar et al. | |
| 6,808,024 | B2 | 10/2004 | Schwendemann et al. | |
| 6,810,958 | B2 | 11/2004 | Szarka et al. | |
| 2003/0000704 | A1 | 1/2003 | Reynolds | |
| 2003/0029611 | A1 | 2/2003 | Owens | |
| 2003/0072208 | A1 | 4/2003 | Rondeau et al. | |
| 2003/0192695 | A1 | 10/2003 | Dillenbeck et al. | |
| 2004/0079553 | A1 | 4/2004 | Livingstone | |
| 2004/0084182 | A1 | 5/2004 | Edgar et al. | |
| 2004/0099413 | A1 | 5/2004 | Arceneaux | |
| 2004/0104050 | A1 | 6/2004 | Järvelä et al. | |
| 2004/0104052 | A1 | 6/2004 | Livingstone | |
| 2004/0177962 | A1 | 9/2004 | Bour | |
| 2004/0231846 | A1 | 11/2004 | Griffith et al. | 166/291 |
| 2005/0061546 | A1 | 3/2005 | Hannegan | |
| 2005/0183857 | A1 | 8/2005 | Rogers et al. | |
| 2006/0016599 | A1 | 1/2006 | Badalamenti et al. | |
| 2006/0016600 | A1 | 1/2006 | Badalamenti et al. | |
| 2006/0042798 | A1 | 3/2006 | Badalamenti et al. | |
| 2006/0086499 | A1 | 4/2006 | Badalamenti et al. | |
| 2006/0086502 | A1 | 4/2006 | Reddy et al. | |
| 2006/0086503 | A1 | 4/2006 | Reddy et al. | |
| 2006/0131018 | A1 | 6/2006 | Rogers et al. | |

FOREIGN PATENT DOCUMENTS

| | | | |
|---|---|---|---|
| GB | 2193741 | | 2/1988 |
| GB | 2327442 | A | 11/1999 |
| GB | 2348828 | A | 10/2000 |
| RU | 1774986 | | 11/1992 |
| RU | 1778274 | | 11/1992 |
| RU | 1542143 | C | 12/1994 |
| RU | 2067158 | | 9/1996 |
| RU | 2 086 752 | C1 | 8/1997 |
| SU | 571584 | | 9/1977 |
| SU | 1420139 | A1 | 8/1988 |
| SU | 1534183 | | 1/1990 |
| SU | 1716096 | A1 | 2/1992 |
| SU | 1723309 | A1 | 3/1992 |
| SU | 1758211 | A1 | 8/1992 |
| WO | WO 2004/104366 | | 12/2004 |
| WO | WO 2005/083229 | A1 | 9/2005 |
| WO | WO 2006/008490 | A1 | 1/2006 |
| WO | WO 2006/064184 | A1 | 6/2006 |

OTHER PUBLICATIONS

Foreign Communication From a Related Counter Part Application, Jan. 8, 2007.

Foreign Communication From a Related Counter Part Application, Jan. 17, 2007.

Foreign Communication From a Related Counterpart Application (With Cited References), Feb. 27, 2007.

Griffith, et al., "Reverse Circulation of Cement on Primary Jobs Increases Cement Column Height Across Weak Formations," Society of Petroleum Engineers, SPE 25440, 315-319, Mar. 22-23, 1993.

Filippov, et al., "Expandable Tubular Solutions," Society of Petroleum Engineers, SPE 56500, Oct. 3-6, 1999.

Daigle, et al., "Expandable Tubulars: Field Examples of Application in Well Construction and Remediation," Society of Petroleum Engineers, SPE 62958, Oct. 1-4, 2000.

Carpenter, et al., "Remediating Sustained Casing Pressure by Forming a Downhole Annular Seal With Low-Melt-Point Eutectic Metal," IADC/SPE 87198, Mar. 2-4, 2004.

Halliburton Casing Sales Manual, Section 4, Cementing Plugs, pp. 4-29 and 4-30, Oct. 6, 1993.

G.L. Cales, "The Development and Applications of Solid Expandable Tubular Technology," Paper No. 2003-136, Petroleum Society's Canadian International Petroleum Conference 2003, Jun. 10-12, 2003.

Gonzales, et al., "Increasing Effective Fracture Gradients by Managing Wellbore Temperatures," IADC/SPE 87217, Mar. 2-4, 2004.
Fryer, "Evaluation of the Effects of Multiples in Seismic Data From the Gulf Using Vertical Seismic Profiles," SPE 25540, 1993.
Griffith, "Monitoring Circulatable Hole With Real-Time Correction: Case Histories," SPE 29470, 1995.
Ravi, "Drill-Cutting Removal in a Horizontal Wellbore for Cementing," IADC/SPE 35081, 1996.
MacEachern, et al., "Advances in Tieback Cementing," IADC/SPE 79907, 2003.
Davies, et al, "Reverse Circulation of Primary Cementing Jobs—Evaluation and Case History," IADC/SPE 87197, Mar. 2-4, 2004.
Abstract No. XP-002283587, "Casing String Reverse Cemented Unit Enhance Efficiency Hollow Pusher Housing".
Abstract No. XP-002283586, "Reverse Cemented Casing String Reduce Effect Intermediate Layer Mix Cement Slurry Drill Mud Quality Lower Section Cement Lining".
Brochure, Enventure Global Technology, "Expandable-Tubular Technology," pp. 1-6, 1999.
Dupal, et al, "Solid Expandable Tubular Technology—A Year of Case Histories in the Drilling Environment," SPE/IADC 67770, Feb. 27-Mar. 1, 2001.
DeMong, et al., "Planning the Well Construction Process for the Use of Solid Expandable Casing," SPE/IADC 85303, Oct. 20-22, 2003.
Waddell, et al., "Installation of Solid Expandable Tubular Systems Through Milled Casing Windows," IADC/SPE 87208, Mar. 2-4, 2004.
DeMong, et al., "Breakthroughs Using Solid Expandable Tubulars to Construct Extended Reach Wells," IADC/SPE 87209, Mar. 2-4, 2004.
Escobar, et al., "Increasing Solid Expandable Tubular Technology Reliability in a Myriad of Downhole Environments," SPE 81094, Apr. 27-30, 2003.
Foreign Communication From a Related Counter Part Application, Oct. 12, 2005.
Foreign Communication From a Related Counter Part Application, Sep. 30, 2005.
Foreign Communication From a Related Counter Part Application, Dec. 7, 2005.
Halliburton Brochure Entitled "Bentonite (Halliburton Gel) Viscosifier", 1999.
Halliburton Brochure Entitled "Cal-Seal 60 Cement Accelerator", 1999.
Halliburton Brochure Entitled "Diacel D Lightweight Cement Additive", 1999.
Halliburton Brochure Entitled "Cementing Flex-Plug® OBM Lost-Circulation Material", 2004.
Halliburton Brochure Entitled "Cementing Flexplug® W Lost-Circulation Material", 2004.
Halliburton Brochure Entitled "Gilsonite Lost-Circulation Additive", 1999.
Halliburton Brochure Entitled "Micro Fly Ash Cement Component", 1999.
Halliburton Brochure Entitled "Silicalite Cement Additive", 1999.
Halliburton Brochure Entitled "Spherelite Cement Additive", 1999.
Halliburton Brochure Entitled "Increased Integrity With the StrataLock Stabilization System", 1998.
Halliburton Brochure Entitled "Perlite Cement Additive", 1999.
Halliburton Brochure Entitled "The PermSeal System Versatile, Cost-Effective Sealants for Conformance Applications", 2002.
Halliburton Brochure Entitled "Pozmix® A Cement Additive", 1999.
Foreign Communication From a Related Counter Part Application, Dec. 9, 2005.
Foreign Communication From a Related Counter Part Application, Feb. 24, 2005.
R. Marquaire et al., "Primary Cementing by Reverse Circulation Solves Critical Problem in the North Hassi-Messaoud Field, Algeria", SPE 1111., Feb. 1966.
Foreign Communication From a Related Counter Part Application, Dec. 27, 2005.
Foreign Communication From a Related Counter Part Application, Feb. 23, 2006.

METHODS AND APPARATUS FOR COMPLETION OF WELL BORES

BACKGROUND

The present invention relates to methods and devices for completion of well bores and more particularly, to reverse circulation cementing of casing strings in well bores.

Conventional methods for completion of well bores typically involve cementing a casing string or multiple casing strings in a well bore. Cementing of a casing string is often accomplished by pumping a cement slurry down the inside of a tubing, a casing, and then back up the annular space around the casing. In this way, a cement slurry may be introduced into the annular space of the casing (e.g. the annular space between the casing to be cemented and the open hole or outer casing to which the casing is to be cemented).

Cementing in this fashion has several drawbacks. In particular, high pressures are required to "lift" the cement up into the annular space around the casing. These high delivery pressures may, in some cases, cause formation damage. Likewise, high delivery pressures can cause the undesirable effect of inadvertently "floating" the casing string. That is, exposing the bottom hole of the well bore to high delivery pressures can, in some cases, cause the casing string to "float" upward.

Another method of cementing casing, sometimes referred to as reverse circulation cementing, involves introducing the cement slurry directly from the surface into the annular space rather than introducing the cement slurry down the casing string itself. In particular, reverse circulation cementing avoids the higher pressures necessary to lift the cement slurry up the annulus. Other disadvantages of having to pump the cement slurry all the way down the casing string and then up the annulus are that it requires a much longer duration of time than reverse circulation cementing. This increased job time is disadvantageous because of the additional costs associated with a longer duration cementing job. Moreover, the additional time required often necessitates a longer set delay time, which may require additional set retarders or other chemicals to be added to the cement slurry.

Further, pumping a cement slurry all the way to the bottom hole of the well bore exposes the cement slurry to higher temperatures than would otherwise be necessary had the cement slurry been introduced directly from the surface to the annulus to be cemented. This exposure to higher temperatures at the bottom hole is undesirable, in part, because the higher temperatures may cause the cement to set prematurely or may cause the operator to modify the cement composition to be able to withstand the higher temperatures, which may result in a less desirable final cementing completion.

Thus, reverse circulation cementing has many advantages over conventional cementing. Nevertheless, reverse circulation cementing involves other challenges such as fluidic access to the annulus. Unfortunately, conventional methods for isolating the casing annulus either do not permit reverse circulation cementing or often involve complex and/or expensive equipment. In some cases, the equipment used for isolating the casing annulus for a reverse circulation cementing requires that the drilling rig remain at the well location for the duration of the cementing job. Requiring the drilling rig to stay at the well during a cementing operations is problematic in part because the drilling rig may not be used to drill subsequent wells during the cementing job and the cost of keeping the drilling rig on location is often quite high.

SUMMARY

The present invention relates to methods and devices for completion of well bores and more particularly, to reverse circulation cementing of casing strings in well bores.

In one embodiment, the present invention provides a method for providing fluidic access to an outer annulus of a casing string within a well bore comprising providing an apparatus comprising a casing hanger, the casing hanger comprising a fluid port wherein the fluid port provides fluidic access to an outer annulus by allowing fluid to pass through the casing hanger, a landing sub attached to the casing hanger, and an isolation device attached to the landing sub wherein the isolation device is adapted to allow fluidic isolation of a portion of the landing sub; landing the apparatus at the well bore wherein the isolation device provides fluidic isolation of a portion of an outer annulus of the well bore; providing a cement slurry; introducing the cement slurry into the outer annulus of the well bore via the fluid port; and allowing the cement slurry to set up in the outer annulus of the well bore.

In another embodiment, the present invention provides an apparatus for providing fluidic access to an outer annulus of a casing string within a well bore comprising a casing hanger, the casing hanger comprising a fluid port wherein the fluid port provides fluidic access to an outer annulus by allowing fluid to pass through the casing hanger; a landing sub attached to the casing hanger; and an isolation device attached to the landing sub wherein the isolation device is adapted to allow fluidic isolation of a portion of the landing sub from a portion of the outer annulus of the well bore.

In other embodiments, the present invention provides a reverse circulation cementing system comprising a casing string disposed within a well bore, the well bore having an outer annulus formed by the casing string being disposed within the well bore; a casing hanger disposed about a longitudinal portion of the casing string, the casing hanger comprising a fluid port wherein the fluid port provides fluidic access to an outer annulus by allowing fluid to pass through the casing hanger; a landing sub attached to the casing hanger; and an isolation device attached to the landing sub wherein the isolation device adapted to allow fluidic isolation of a portion of the landing sub from a portion of the outer annulus of the well bore.

The features and advantages of the present invention will be apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DETAILED DESCRIPTION

The present invention relates to methods and devices for completion of well bores and more particularly, to reverse circulation cementing of casing strings in well bores.

The methods and devices of the present invention may allow for an improved reverse circulation cementing of the annular space of a casing to be cemented. In particular, the reverse circulation cementing devices and methods of the present invention may provide an improved fluidic isolation of a well bore outer annulus for cementing casing in well bores. In certain embodiments, a device of the present invention may comprise a casing hanger, the casing hanger comprising a fluid port wherein the fluid port provides fluidic access to an outer annulus by allowing fluid to pass through the casing hanger; a landing sub attached to the casing hanger; and an isolation device attached to the landing sub wherein the isolation device is adapted to allow fluidic isolation of a portion of the landing sub from a portion of the outer annulus of the well bore.

To facilitate a better understanding of the present invention, the following examples of certain embodiments are given. In no way should the following examples be read to limit, or define, the scope of the invention.

Figure 1:
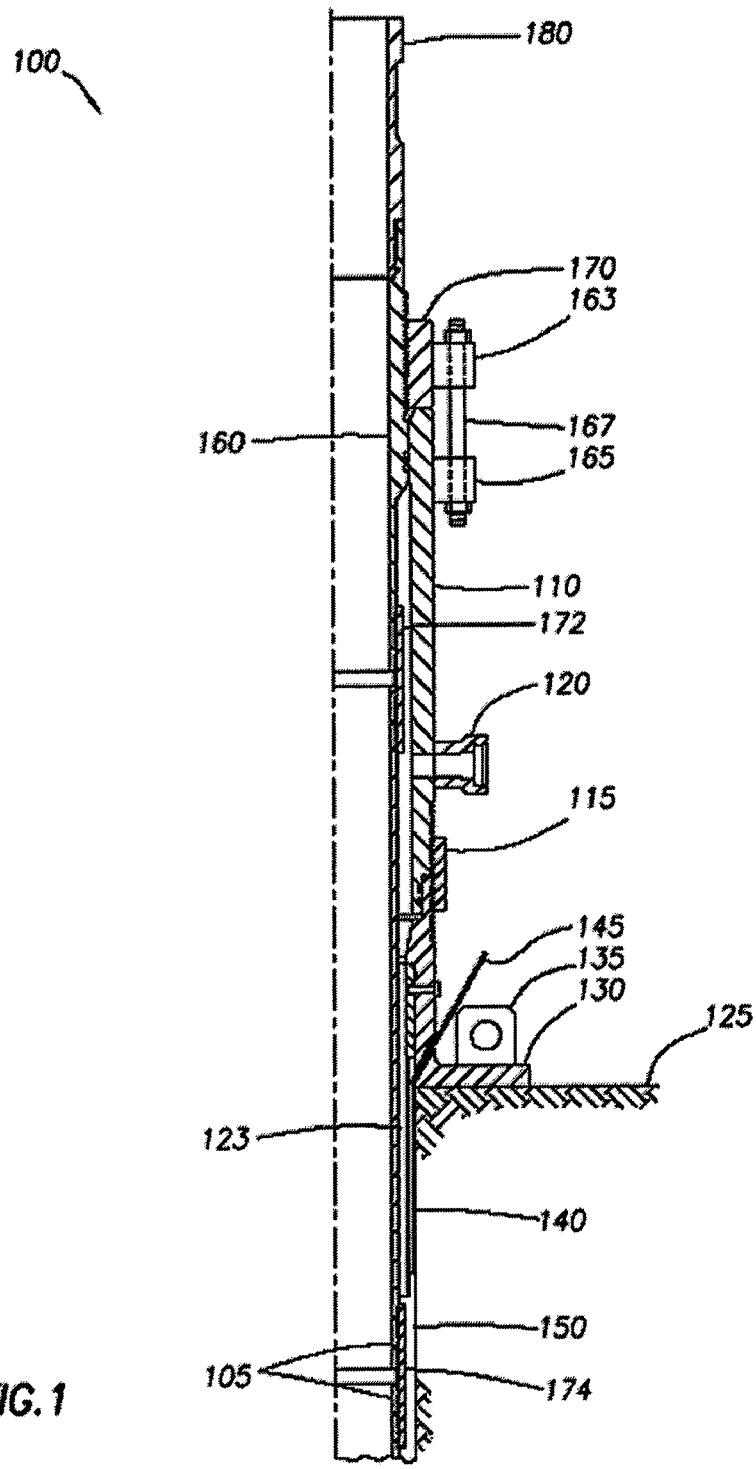
FIG. 1 illustrates a cross-sectional view of an apparatus for providing fluidic access to the outer annulus of a casing string in a well bore in accordance with one embodiment of the present invention.

FIG. 1 illustrates a cross-sectional view of reverse circulation cementing apparatus 100 interacting with casing string 105 in a well bore in accordance with one embodiment of the present invention. Casing hanger 110 may be attached to landing sub 130 by collar 115 or any attachment means known in the art. Although landing sub 130 is depicted as a separate piece from casing hanger 110, landing sub 130 may be integral to casing hanger 110 in certain embodiments. Landing sub 130 may seat against ground 125, or any other support structure near the ground, to provide support for reverse circulation cementing apparatus 100. Casing hanger 110 may comprise a fluid port 120. Fluid port 120 may be used, among other things, to introduce cement slurry compositions to outer annulus 150 by way of fluid conduit 123. In certain embodiments, fluid port 120 may be integral to casing hanger 110. Isolation device 140 may provide fluidic isolation of outer annulus 150. In this way, fluid introduced into outer annulus 150 is prevented from exiting outer annulus 150 by leakage around landing sub 130. However, the fluid insertion tube 145 may be any means for inserting fluid.

Isolation device 140 may be any device that provides at least partial fluidic isolation of outer annulus 150. In certain embodiments, isolation device 140 may comprise a rubber cup, a cement basket, or a retrievable packer. In the embodiment depicted in FIG. 1, isolation device 140 is shown as an inflatable tube. The inflatable tube may be expanded or inflated with a fluid. In certain embodiments, the fluid may be a hardening fluid, which may be a settable fluid capable of permanently hardening in a portion of outer annulus 150. Fluid insertion tube 145 may be used to introduce a fluid into isolation device 140 as necessary. In certain embodiments, fluid insertion tube 145 may be a hose.

Sealing mandrel 160 may be attached to casing hanger 110 by any means known in the art. In certain embodiments, sealing mandrel 160 may be integral to casing hanger 110. In the embodiment depicted in FIG. 1, sealing mandrel 160 is shown as attached to casing hanger 110 via load bearing ring 170. Load bearing ring 170 is in turn attached to turnbuckles 163 and 165 via bolt 167. Sealing mandrel 160 may also be attached to casing string 105 via casing collars 172 and 174. In this way, sealing mandrel 160 may support the weight of casing string 105.

Conversely, sealing mandrel 160 may be removed from reverse circulation cementing apparatus 100 by removing bolt 167 from turnbuckles 163 and 165 thus allowing for the release of sealing mandrel 160 from casing hanger 110.

Handling sub 180 may optionally be attached to sealing mandrel 160. Handling sub 180 allows for external handling equipment to attach to and manipulate as necessary reverse circulation cementing apparatus 100. Likewise, landing eye 135 also allows for external handling equipment to attach to and manipulate as necessary reverse circulation cementing apparatus 100. In this way, casing hanger 110 in conjunction with sealing mandrel 160 may support the weight of casing string 105.

Figure 2B:
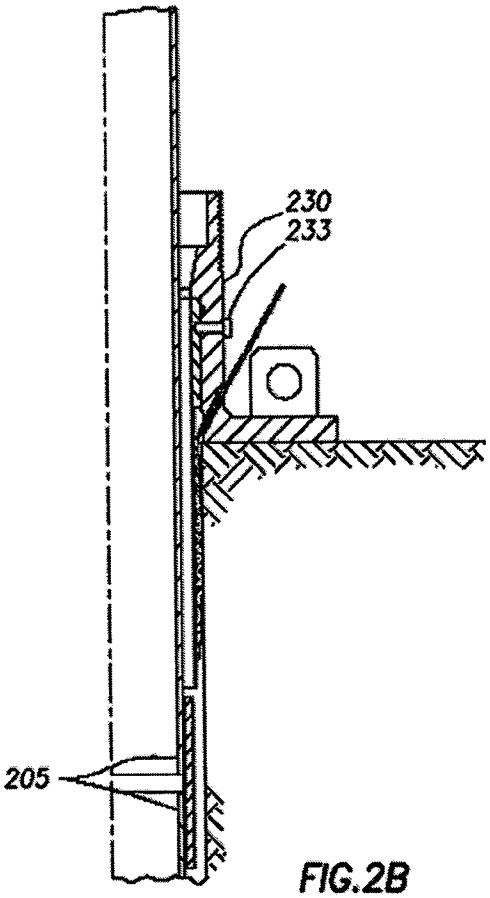
FIG. 2B illustrates a cross-sectional view of a well bore after removal of a portion of the apparatus of FIG. 2A in accordance with one embodiment of the present invention.
Figure 2A:
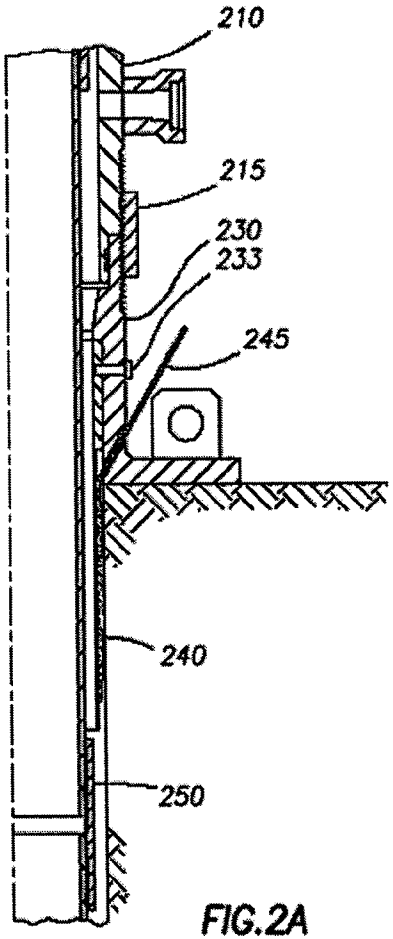
FIG. 2A illustrates a cross-sectional view of a portion of an apparatus for providing fluidic access to an outer annulus of a casing string showing a hardening fluid being used to provide fluidic isolation of a portion of a landing sub from the outer annulus of the casing string in accordance with one embodiment of the present invention.
Figure 2C:
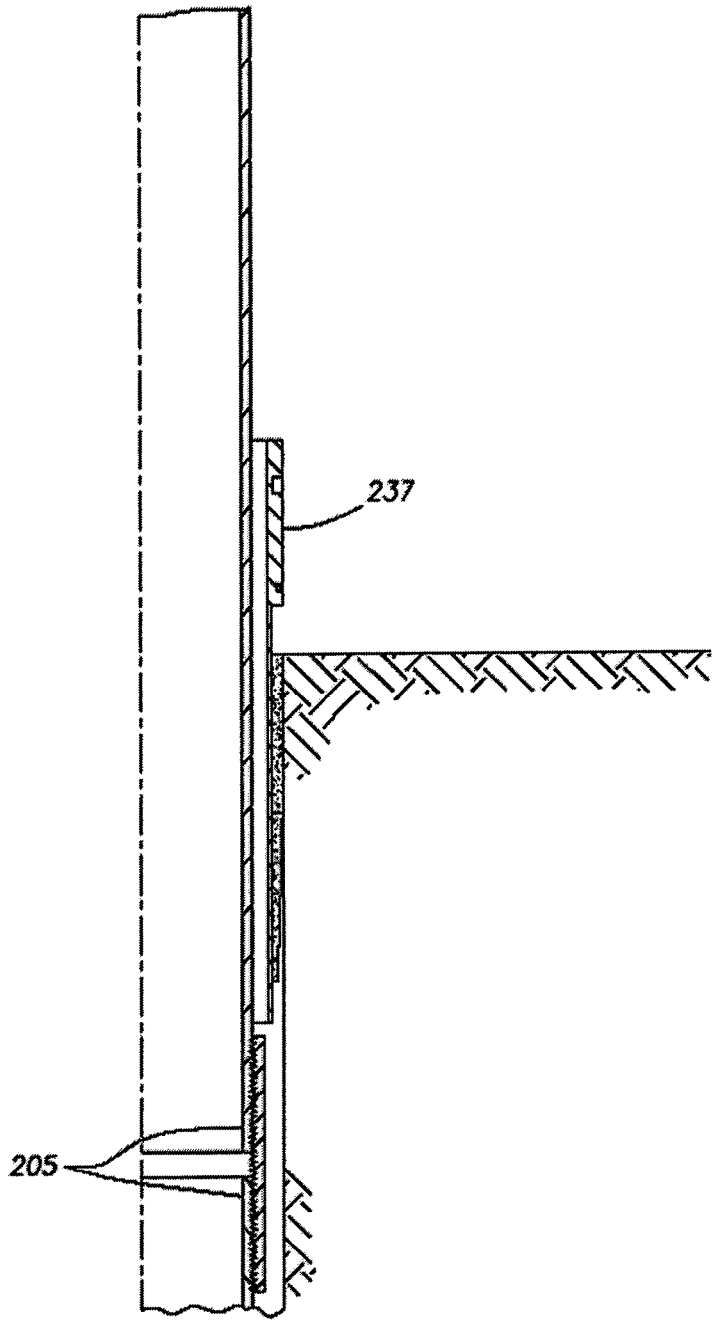
FIG. 2C illustrates a cross-sectional view of well bore after removal of the apparatus of FIGS. 2A and 2B in accordance with one embodiment of the present invention.

FIGS. 2A-2C illustrate a cross-sectional view of a portion of a reverse circulation cementing apparatus showing a hardening fluid being used to provide fluidic isolation of a portion of a landing sub from the outer annulus of the casing string in accordance with one embodiment of the present invention.

Fluid insertion tube 245 may be used to introduce a hardening fluid, for example, cement, into isolation device 240, depicted here as an expandable tube. By sealing off the top portion of outer annulus 250, isolation device 240 provides fluidic isolation of outer annulus 250.

As in FIG. 1, FIG. 2A shows casing hanger 210 attached to landing sub 230 via collar 215. Casing collar 215 may be removed to allow casing hanger 210 to detach (as illustrated in FIG. 2B).

FIG. 2B illustrates a cross-sectional view of well bore after removal of a portion of the reverse circulation cementing apparatus of FIG. 2A in accordance with one embodiment of the present invention.

In FIG. 2B, landing sub 230 is shown after detachment of casing hanger 210. In certain embodiments, landing sub 230 may be left at the well site permanently. In still other embodiments, landing sub 230 may be removed. In such a removal, pin 233 may be removed to allow detachment of landing sub 230.

FIG. 2C illustrates a cross-sectional view of well bore after removal of a portion of the reverse circulation cementing apparatus of FIGS. 2A and 2B in accordance with one embodiment of the present invention. In particular, FIG. 2C shows the remaining portion of the reverse circulation cementing apparatus after removal of landing sub 230. Casing string 205 remains in place in the well bore after removal of landing sub 230. Remaining outer annular sleeve 237 may be severed at ground level or left in place as desired.

Figure 3:
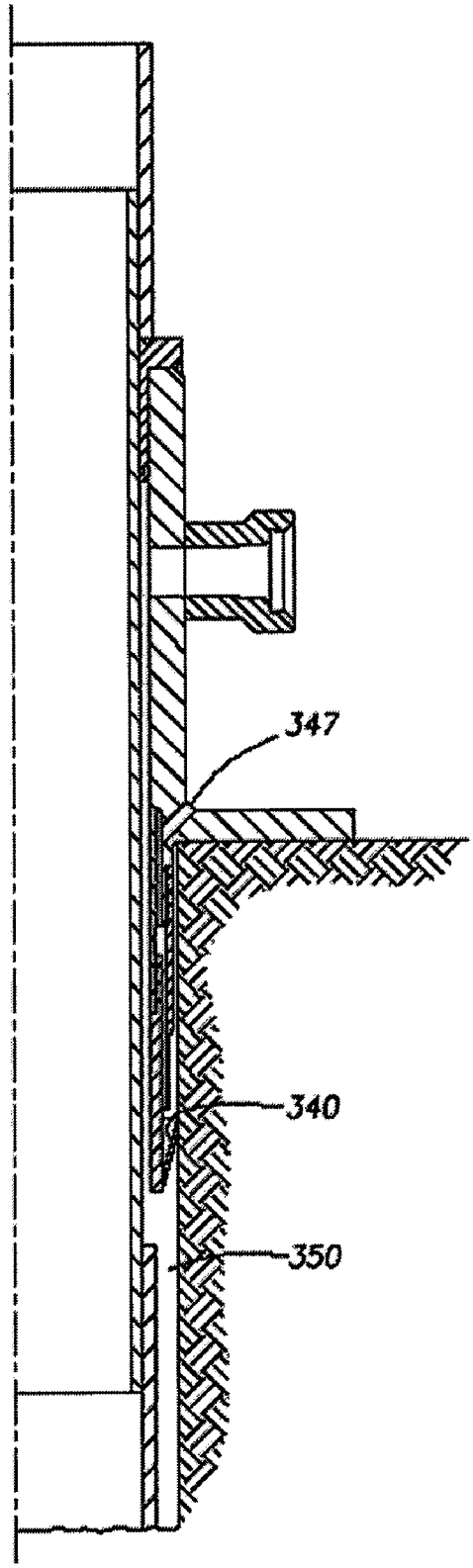
FIG. 3 illustrates a cross-sectional view of an isolation device of an apparatus for providing fluidic access to an outer annulus of a casing string, interacting with its environment in accordance with one embodiment of the present invention.

FIG. 3 illustrates a cross-sectional view of an isolation device of a reverse circulation cementing apparatus interacting with its environment in accordance with one embodiment of the present invention. In particular, isolation device 340, represented schematically, may be any device suitable for providing fluidic isolation to the outer annulus. Suitable examples include cement basket isolation devices or a rubber cup isolation devices. In either case, isolation device 340 provides fluidic isolation of outer annulus 350. Fluid insertion port 347 may be used to introduce a hardenable fluid to provide additional fluidic isolation optionally as desired. In certain embodiments, such as when a hardenable fluid is used, the reverse circulation cementing apparatus may be permanently affixed to the well head.

Figure 4:
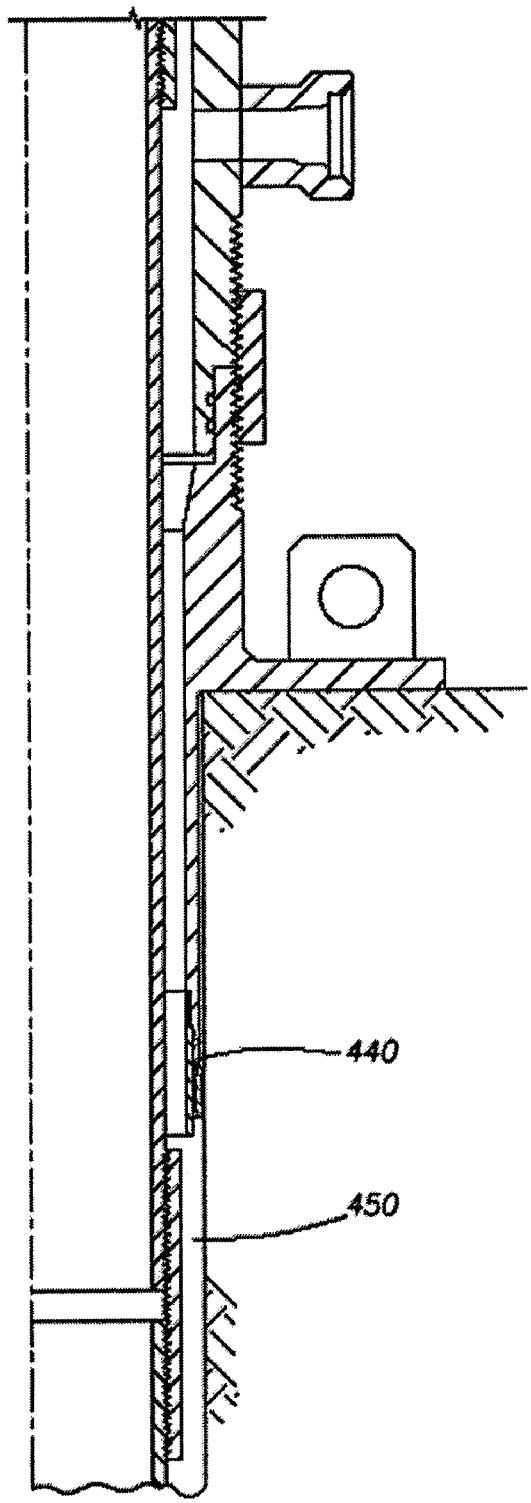
FIG. 4 illustrates a cross-sectional view of an isolation device interacting with its environment in accordance with one embodiment of the present invention.

FIG. 4 illustrates a cross-sectional view of a retrievable cup or inflatable packer interacting with its environment in accordance with one embodiment of the present invention. Isolation device 440, depicted as a retrievable cup in this embodiment, may provide fluidic isolation of outer annulus 450. Certain embodiments of the reverse circulation cementing apparatus may forego the use of a hardenable fluid such as when a retrievable cup is used.

Figure 5A:
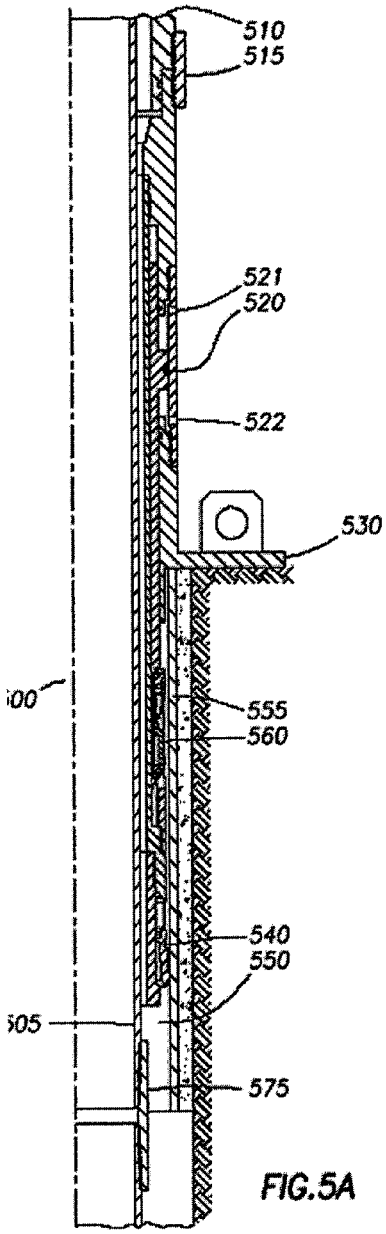
FIG. 5A illustrates a cross-sectional view of an apparatus for providing fluidic access to an outer annulus of a casing string, the apparatus containing a slip shown in its installed position.
Figure 5B:
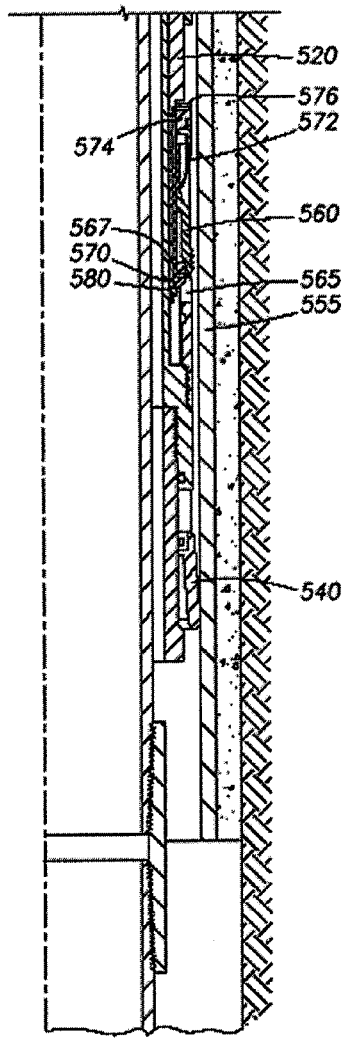
FIG. 5B illustrates a detailed view of the slip arrangement of the apparatus of FIG. 5A, for providing fluidic access to an outer annulus of a casing string.
Figure 5C:
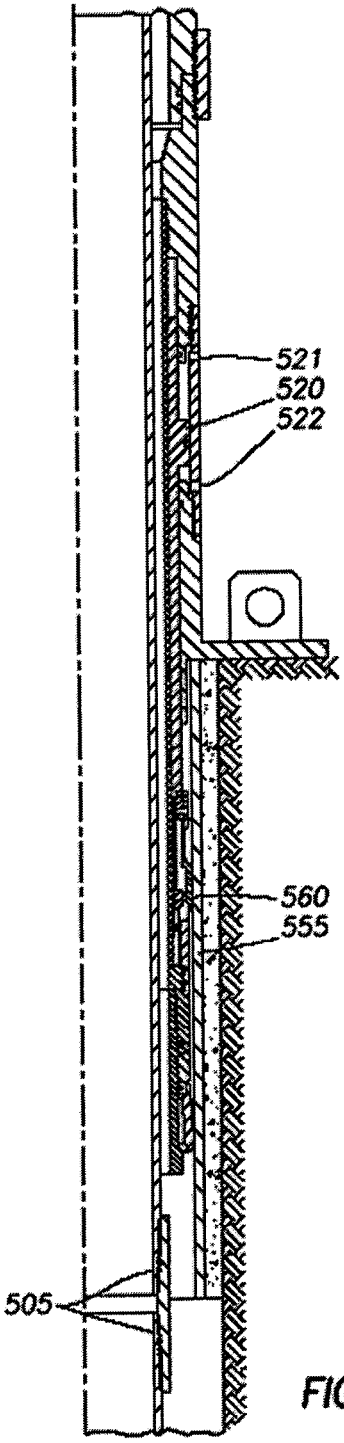
FIG. 5C illustrates a cross-sectional view of the apparatus of FIG. 5A after engagement of the slip with a subsurface casing string.
Figure 5D:
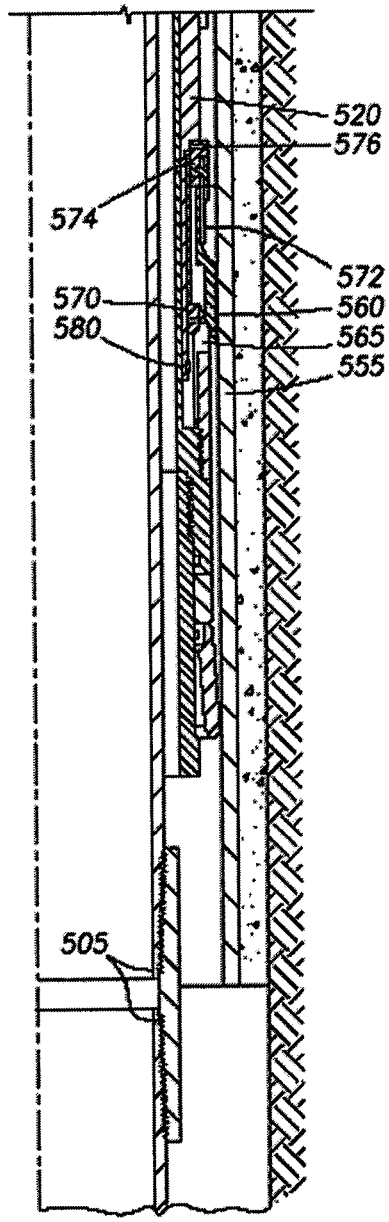
FIG. 5D illustrates a detailed view of the slip arrangement of the apparatus of FIG. 5C, after engagement of the mechanical slip with a subsurface casing string.

FIGS. 5A and 5B illustrate a cross-sectional view of slip apparatus 500 to prevent the "floating" of the casing string on top of the cement slurry, the apparatus having mechanical slip 560 for preventing "floating" of the casing string 505. In FIGS. 5A and 5B, slip apparatus 500 is shown in its original installed position. FIGS. 5C and 5D illustrate mechanical slip 560 of apparatus 500 being engaged to subsurface casing string 555. Successive FIGS. 5E-5J illustrate the subsequent disengagement of apparatus 500 to return mechanical slip 560 to its original installed position.

FIG. 5A illustrates an overview of slip apparatus 500 interacting with subsurface casing string 555 cemented into a well bore. FIG. 5B illustrates a detailed view of mechanical slip 560 of apparatus 500. Looking initially at FIG. 5A, an overview of apparatus 500 is shown in its original installed position. As in FIG. 1, FIG. 5A shows casing hanger 510 attached to landing sub 530 via collar 515. The portion of apparatus 500 positioned above collar 515 (not illustrated) is as described in FIG. 1. In the embodiment depicted in FIG. 5A, an actuating mandrel 520 is in communication with ports 521 and 522. Actuating mandrel 520 may translate downward in response to a pressure applied to port 521. Actuating mandrel 520 may translate upward in response to a pressure applied to port 522.

Isolation device 540, depicted as a retrievable cup in this embodiment, may be in engagement with subsurface casing string 555, which in this embodiment, is cemented into place within the well bore. By engaging subsurface casing string 555, isolation device 540 provides fluidic isolation of outer annulus 550.

In this embodiment, casing string 505 connected by collar 575 may be positioned internal to subsurface casing string 555. Positioned above isolation device 540 is illustrated mechanical slip 560, in accordance with one embodiment of the present invention, which is depicted in FIG. 5B in an enlarged view.

Turning to FIG. 5B, in more detail, in this embodiment, mechanical slip 560 is in its original installed position. Mechanical slip 560 is disengaged from the subsurface casing string 555 and is positioned on an inclined surface of wedge 565. Wedge 565 is attached by a shear pin 567 to inner ring 570. Wedge 565 may have fingers (not illustrated) which are grooves internal to wedge 565 that are compressed as a result of contact with inner ring 570. Flexible member 572 is attached to mechanical slip 560 to aid in the retention of mechanical slip 560 in the disengaged position. In certain embodiments, flexible member 572 may be a spring. Flexible member 572 is further attached to retaining ring 574. Any suitable means known in the art may be used to attach flexible member 572 to retaining ring 574 and mechanical slip 560. In this embodiment, retaining ring 574 is coupled to actuating mandrel 520 by a shear pin 576. Any suitable means known in the art may be used to attach actuating mandrel 520 to retaining ring 574. Positioned on the lower portion of actuating mandrel 520 is a snap ring 580, which in this initial position, is engaged with inner ring 570.

FIGS. 5C and 5D illustrate the mechanical slip 560 of FIGS. 5A and 5B engaged with a subsurface casing 555. FIG. 5C shows an overview view of mechanical slip 560 engaged with the subsurface casing string 555. In this position, mechanical slip 560 may prevent casing string 505 from "floating" during reverse cementing operations. In the embodiment illustrated in FIG. 5C, pressure has been applied to the actuating mandrel 520 via port 521. The amount of pressure applied to the mandrel is sufficient to allow the mechanical slip 560 to engage the subsurface casing string 555. In certain embodiments, the pressure applied may be pressure resulting from injection of fluid into the port 521. As shown in FIG. 5C, the pressure applied to actuating mandrel 520 forces mandrel 520 downward, further into the well bore. The shear pin 576 coupling retaining ring 574 and actuating mandrel 520 is sheared, as shown in FIG. 5D. As actuating mandrel 520 compresses retaining ring 574, mechanical slip 560 is forced down the inclined surface of wedge 565 and engages the subsurface casing string 555. Flexible member 572 is pulled into tension as mechanical slip 560 engages the subsurface casing string 555. Snap ring 580 is disengaged from inner ring 570, as a result of the change in position of the mandrel 520. Mechanical slip 560 is now engaged with subsurface casing string 555 and a reverse cementing job may be performed without "floating" the casing string 505. Although mechanical slip 560 is depicted engaged with subsurface casing string 505, mechanical slip 560 may be adapted for use in an open hole without subsurface casing in certain embodiments. FIGS. 5K and 5L illustrate the mechanical slip 560 of FIGS. 5C and 5D in an openhole well bore.

Figure 5E:
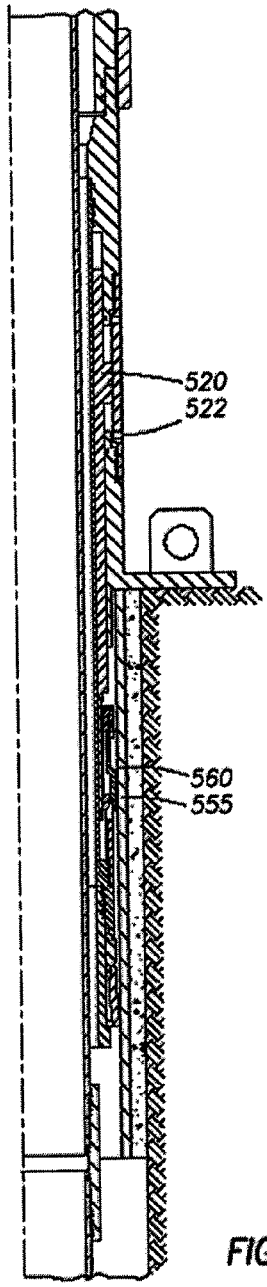
FIG. 5E illustrates a cross-sectional view of the apparatus of FIG. 5C showing the mechanical slip in the process of being returned to its original installed position.
Figure 5F:
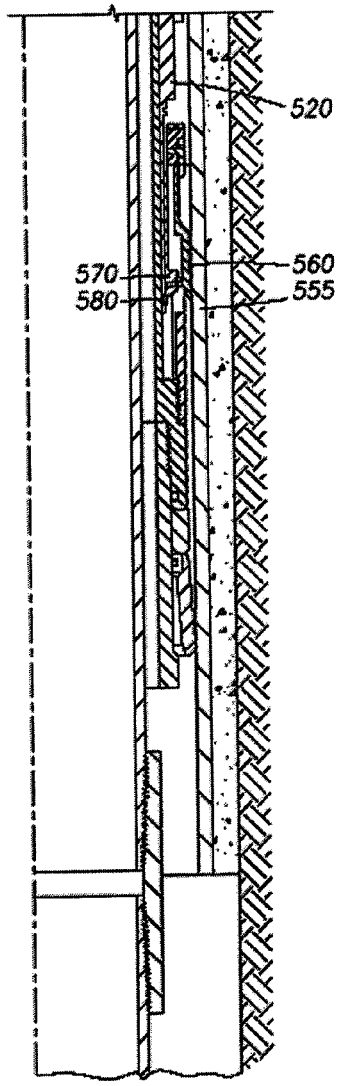
FIG. 5F illustrates a detailed view of the slip arrangement of the apparatus of FIG. 5E showing the mechanical slip in the process of being returned to its original installed position.

FIGS. 5E and 5F illustrate the apparatus 500 of FIGS. 5C and 5D in the process of disengagement of mechanical slip 560 from subsurface casing 555. The disengagement of mechanical slip 560 may occur subsequent to a reverse circulation cementing job. In this embodiment illustrated in FIG. 5E, to begin the process of disengagement of mechanical slip 560 from the subsurface casing 555, pressure is applied at port 522 to actuating mandrel 520. As pressure is applied to actuating mandrel 520, actuating mandrel 520 moves upward in response such that snap ring 580 engages inner ring 570, as illustrated in FIG. 5F.

Figure 5G:
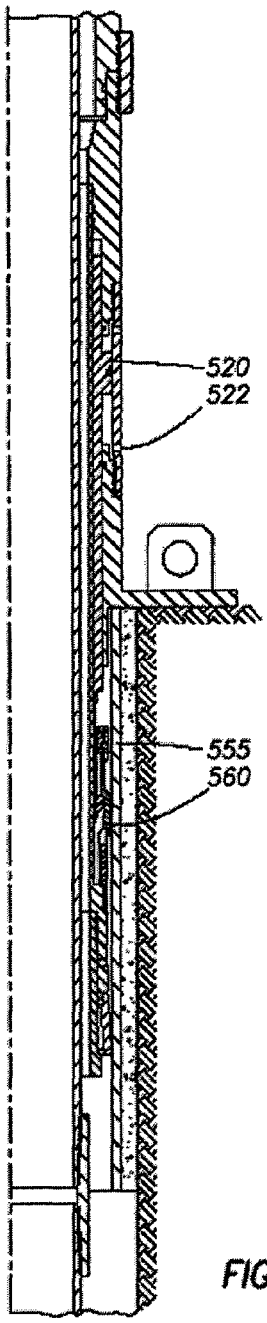
FIG. 5G illustrates a cross-sectional view of the apparatus of FIG. 5E showing the mechanical slip in the process of being returned to its original installed position, after shearing of a pin connecting an inner ring and a wedge.
Figure 5H:
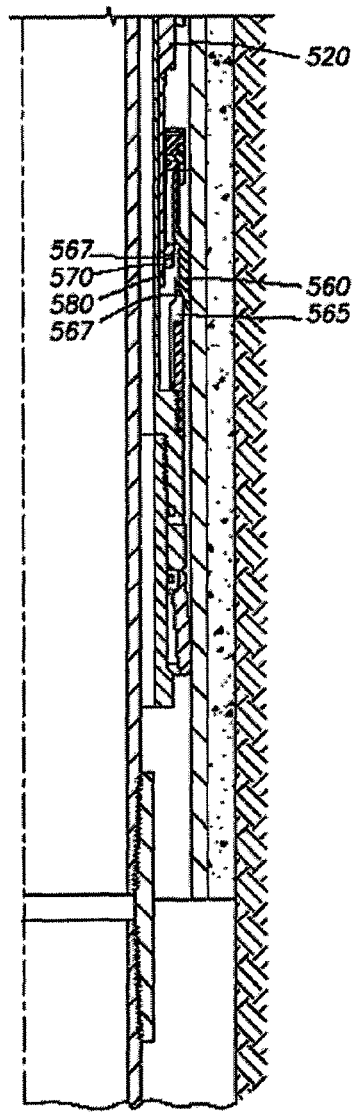
FIG. 5H illustrates a detailed view of the slip arrangement of the apparatus of FIG. 5G showing the mechanical slip in the process of being returned to its original installed position, after shearing of a pin connecting an inner ring and a wedge.

FIGS. 5G and 5H shows the apparatus 500 as it continues the process of disengagement of mechanical slip 560 from subsurface casing 555. As pressure is continued to be applied to actuating mandrel 520 through port 522, snap ring 580 is forced further upward against the lower surface of inner ring 570, as shown in FIG. 5H. The force is sufficient such that shear pin 567 connecting inner ring 570 and wedge 565 is sheared, thereby releasing inner ring 570 from wedge 565. As actuating mandrel 520 continues to move upward, snap ring 580 and inner ring 570 are forced upward until inner ring 570 contacts the upper portion of mechanical slip 560 and begins to pull mechanical slip 560 away from the subsurface casing string 555. With the removal of inner ring 570 from its initial position, the fingers of wedge 565 flex away from mechanical slip 560, which aid in disengaging mechanical slip 560 from subsurface casing string 555.

Figure 5I:
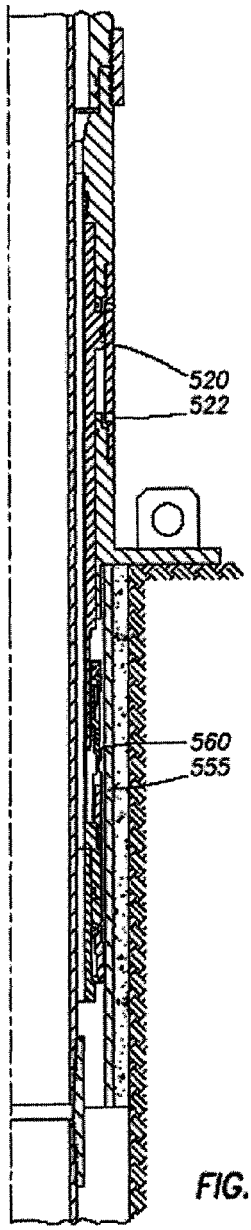
FIG. 5I illustrates a cross-sectional view of the apparatus of FIG. 5G with the mechanical slip fully disengaged from a subsurface casing string.
Figure 5J:
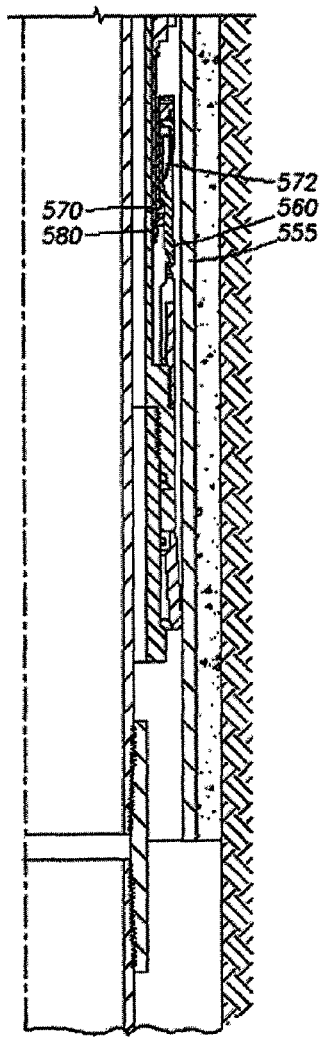
FIG. 5J illustrates a detailed view of the slip arrangement of 5I after the mechanical slip is fully disengaged from a subsurface casing string.
Figure 5K:
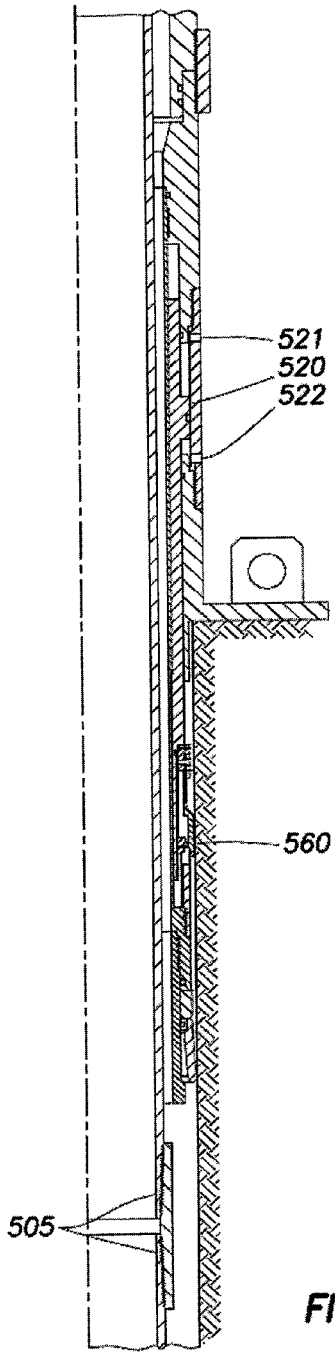
FIG. 5K illustrates a cross-sectional view of the apparatus of FIG. 5A in an open hole well bore.
Figure 5L:
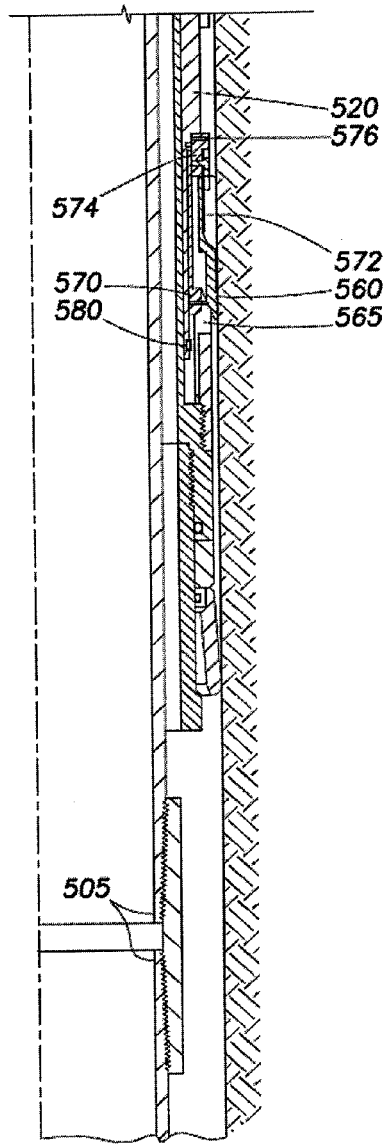
FIG. 5L illustrates a detailed view of the slip arrangement of the apparatus of FIG. 5K in an open hole well bore.

The continued pressure applied via port 522 to actuating mandrel 520, illustrated in FIG. 5I, results in complete disengagement of mechanical slip 560 from subsurface casing string 555. Snap ring 580 and inner ring 570, continue to pull mechanical slip 560 until complete disengagement of mechanical slip 560 from subsurface casing string 555 is achieved, illustrated in FIG. 5J. Flexible member 572 returns to its initial relaxed position, thereby further aiding the disengagement of mechanical slip 560 from subsurface casing string 555.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A method for providing fluidic access to an outer annulus of a casing string within a well bore comprising:

providing an apparatus comprising a casing hanger, the casing hanger comprising a fluid port wherein the fluid port provides fluidic access to the outer annulus by allowing fluid to pass through the casing hanger, a landing sub attached to the casing hanger, an isolation device attached to the landing sub wherein the isolation device is adapted to allow fluidic isolation of a portion of the landing sub, and a mechanical slip disposed above the isolation device engaged with a subsurface section of the well bore, wherein the mechanical slip prevents floating of the casing string;

landing the apparatus at the well bore wherein the isolation device provides fluidic isolation of a portion of the outer annulus;

introducing a cement slurry into the outer annulus via the fluid port; and allowing the cement slurry to set up in the outer annulus.

2. The method of claim 1 wherein the casing hanger is disposed about a longitudinal portion of the casing string.

3. The method of claim 1 wherein the casing hanger is adapted to be removably disposed about a longitudinal portion of the casing string.

4. The method of claim 1 wherein the isolation device is a retrievable rubber cup or a retrievable inflatable packer.

5. The method of claim 1 wherein the isolation device is a cement basket or a permanent inflatable tube.

6. The method of claim 1 further comprising the step of removing the casing hanger, leaving behind the isolation device and the landing sub.

7. The method of claim 1 wherein the well bore is an open hole well bore.

8. The method of claim 1 wherein the mechanical slip engages a subsurface casing string in the subsurface section of the well bore.

9. An apparatus for providing fluidic access to an outer annulus of a casing string within a well bore comprising:

a casing hanger, the casing hanger comprising a fluid port wherein the fluid port provides fluidic access to the outer annulus by allowing fluid to pass through the casing hanger;

a landing sub attached to the casing hanger;

an isolation device attached to the landing sub wherein the isolation device is adapted to allow fluidic isolation of a portion of the landing sub from a portion of the outer annulus; and a mechanical slip disposed above the isolation device which is adapted to engage a subsurface section of the well bore to prevent floating of the casing string.

10. The apparatus of claim 9 wherein the casing hanger is adapted to be removably disposed about a longitudinal portion of the casing string.

11. The apparatus of claim 9 wherein the isolation device is a retrievable rubber cup or a retrievable inflatable packer.

12. The apparatus of claim 9 wherein the isolation device is a cement basket or permanent inflatable tube.

13. The apparatus of claim 9 wherein the mechanical slip is adapted to engage an open hole well bore.

14. The apparatus of claim 9 wherein the mechanical slip is adapted to engage a subsurface casing string in the subsurface section of the well bore.

15. A reverse circulation cementing system comprising:

a casing string disposed within a well bore, the well bore having an outer annulus formed by the casing string being disposed within the well bore;

a casing hanger disposed about a longitudinal portion of the casing string, the casing hanger comprising a fluid port wherein the fluid port provides fluidic access to the outer annulus by allowing fluid to pass through the casing hanger;

a landing sub attached to the casing hanger;

an isolation device attached to the landing sub wherein the isolation device is adapted to allow fluidic isolation of a portion of the landing sub from a portion of the outer annulus; and a mechanical slip disposed above the isolation device which is adapted to engage a subsurface section of the well bore, wherein the mechanical slip prevents floating of the casing string.

16. The system of claim 15 wherein the casing hanger is disposed about a longitudinal portion of the casing string.

17. The system of claim 15 wherein the casing hanger is adapted to be removably disposed about a longitudinal portion of the casing string.

18. The system of claim 15 wherein the isolation device is a retrievable rubber cup.

19. The system of claim 15 wherein the isolation device is a retrievable inflatable packer.

20. The system of claim 15 wherein the isolation device is a cement basket or permanent inflatable tube.

21. The system of claim 15 wherein the mechanical slip is adapted to engage an open hole well bore.

22. The system of claim 15 wherein the mechanical slip is adapted to engage a subsurface casing string in the subsurface section of the well bore.

* * * * *